United States Patent [19]

Wieland

[11] 4,253,396

[45] * Mar. 3, 1981

[54] SHEET GRIPPER

[75] Inventor: Erich G. Wieland, Wurzburg, Fed. Rep. of Germany

[73] Assignee: Koenig & Bauer Aktiengesellschaft, Wurzburg, Fed. Rep. of Germany

[ * ] Notice: The portion of the term of this patent subsequent to Sep. 30, 1997, has been disclaimed.

[21] Appl. No.: 33,646

[22] Filed: Apr. 26, 1979

[30] Foreign Application Priority Data

May 20, 1978 [DE] Fed. Rep. of Germany ..... 2822043

[51] Int. Cl.[3] ..... B41F 21/04

[52] U.S. Cl. ..... 101/409; 101/246; 271/82

[58] Field of Search ..... 101/408, 409, 410, 411, 101/412, 246, 415.1; 271/82, 85, 204, 205, 206, 277

[56] References Cited

U.S. PATENT DOCUMENTS

| | | | |
|---|---|---|---|
| 323,168 | 7/1885 | Lindemeyer, Jr. | 101/412 |
| 1,384,778 | 7/1921 | Rich | 101/412 |
| 1,483,057 | 2/1924 | Warsen | 101/412 |
| 1,600,790 | 9/1926 | Blaine | 101/412 |
| 1,607,142 | 11/1926 | White | 101/409 |
| 2,092,189 | 9/1937 | Stobb | 101/410 |
| 3,536,321 | 10/1970 | Straube | 101/409 X |
| 3,650,211 | 3/1972 | Nentwich | 271/82 X |
| 3,788,639 | 1/1974 | Bru | 101/409 X |
| 4,058,307 | 11/1977 | Bubley | 101/408 |

FOREIGN PATENT DOCUMENTS

| | | | |
|---|---|---|---|
| 506283 | 8/1930 | Fed. Rep. of Germany | 101/410 |
| 670298 | 1/1939 | Fed. Rep. of Germany | 101/412 |
| 1103352 | 3/1961 | Fed. Rep. of Germany | 101/409 |
| 1174804 | 7/1964 | Fed. Rep. of Germany | 101/412 |
| 1761033 | 4/1971 | Fed. Rep. of Germany | 101/412 |
| 6906453 | 2/1975 | Fed. Rep. of Germany | 101/412 |
| 4345 | 12/1891 | Switzerland | 101/412 |
| 310177 | 4/1929 | United Kingdom | 101/410 |
| 1180547 | 2/1970 | United Kingdom | 101/409 |

*Primary Examiner*—J. Reed Fisher

*Attorney, Agent, or Firm*—Jones, Tullar & Cooper

[57] ABSTRACT

A sheet gripper for a sheet-fed rotary printing machine is disclosed. The sheet gripper is secured directly to the oscillating gripper shaft of the impression cylinder of the printing machine and includes a gripper finger having a gripper tip, a gripper base, and a connecting gripper side. A hinge joint assembly between the sheet gripper and gripper shaft is formed by a shoulder on the gripper and a notch on the shaft. Alternatively, the shoulder may be provided on the shaft and the notch formed in the gripper. The gripper is secured to the shaft and is biased toward the shaft by suitable springs or the like. An adjustment assembly is provided to adjust the distance between the gripper tip and an abutment surface on the cylinder.

5 Claims, 3 Drawing Figures

SHEET GRIPPER

FIELD OF THE INVENTION

The present invention is directed generally to a sheet gripper for a rotary printing machine. More particularly, the present invention is directed to a sheet gripper secured to the gripper shaft of an impression cylinder of a rotary printing machine. Most specifically, the present invention is directed to a sheet gripper secured to a gripper shaft and having hinge means formed by cooperating elements on the gripper and shaft. The sheet gripper in accordance with the present invention includes a gripper tip, a gripper base and an intermediate gripper side. This side and the shaft have a cooperating shoulder and notch configuration which form a hinge connection between the gripper and shaft. The gripper is secured to the shaft by suitable means and is spring biased toward the shaft. Adjusting means are provided to position the gripper tip with respect to the gripper abutment surface portion of the impression cylinder.

A generally similar clamping gripper is disclosed in my copending United States patent application Ser. No. 911,573, filed on June 1, 1978 and assigned to the same assignee.

DESCRIPTION OF THE PRIOR ART

Sheet grippers for use with a sheet-fed rotary printing machine wherein the gripper is secured directly to the gripper shaft are generally known in the art as may be seen in German Pat. No. 670,298. A sheet gripper such as shown in this patent is not easily or quickly removed from the gripper shaft for purposes of exchange since the hub of the gripper encircles the gripper shaft. This arrangement makes it impossible to journal the gripper on the shaft with any clearance between the gripper and shaft. Additionally, continuous contact of the gripper edge on the small block causes wear and tear of both parts so that each of the grippers has a different closing space between the gripper and its abutment surface. Further, no adjusting means which are capable of preventing this wear and tear are provided. Accordingly, the known gripper arrangements do not allow for quick replacement, cause undue wear of the gripper and shaft, and are not easily adjustable.

SUMMARY OF THE INVENTION

It is an object of the present invention to provide a sheet gripper which is directly secured to the gripper shaft.

Another object of the present invention is to provide a sheet gripper which is easily removable from the gripper shaft without removing the shaft.

An additional object of the present invention is to provide a sheet gripper which is spring biased toward the gripper shaft.

Yet another object of the present invention is to provide a sheet gripper and gripper shaft having cooperating hinge forming elements.

A further object of the present invention is to provide a sheet gripper having means to adjust the clearance between the gripper tip and the gripper abutment surface.

As will be discussed in greater detail in the description of preferred embodiments, the sheet gripper in accordance with the present invention is comprised generally of a gripper finger having a gripper tip at a first end, a gripper base at a second end, and an interconnecting gripper side. The gripper finger is secured to an oscillating gripper shaft of an impression cylinder and is spring biased toward the shaft by suitable means. A hinge connection between the gripper finger and shaft is provided by a cooperating shoulder and notch arrangement with, in a first embodiment, the notch being provided in the shaft and the shoulder on the gripper finger. In the alternate embodiment, these locations are reversed. An adjusting bolt is carried by the gripper shaft and passes therethrough to contact the gripper base. The space between the gripper tip and its abutment surface on the impression cylinder can thereby be adjusted.

The sheet gripper in accordance with the present invention is quickly and easily attached to or removed from the gripper shaft, does not cause wearing of the gripper shaft, and requires no lubrication. The opening and closing pressures on the gripper are nearly equal and the gripper finger is easily adjusted to correctly contact the abutment surface of the impression cylinder.

BRIEF DESCRIPTION OF DRAWINGS

While the novel features of the sheet gripper of the present invention are set forth with particularity in the appended claims, a full and complete understanding of the invention may be had by referring to the following description of preferred embodiments and as shown in the accompanying drawings in which:

DESCRIPTION OF THE PREFERRED EMBODIMENTS

Figure 1:
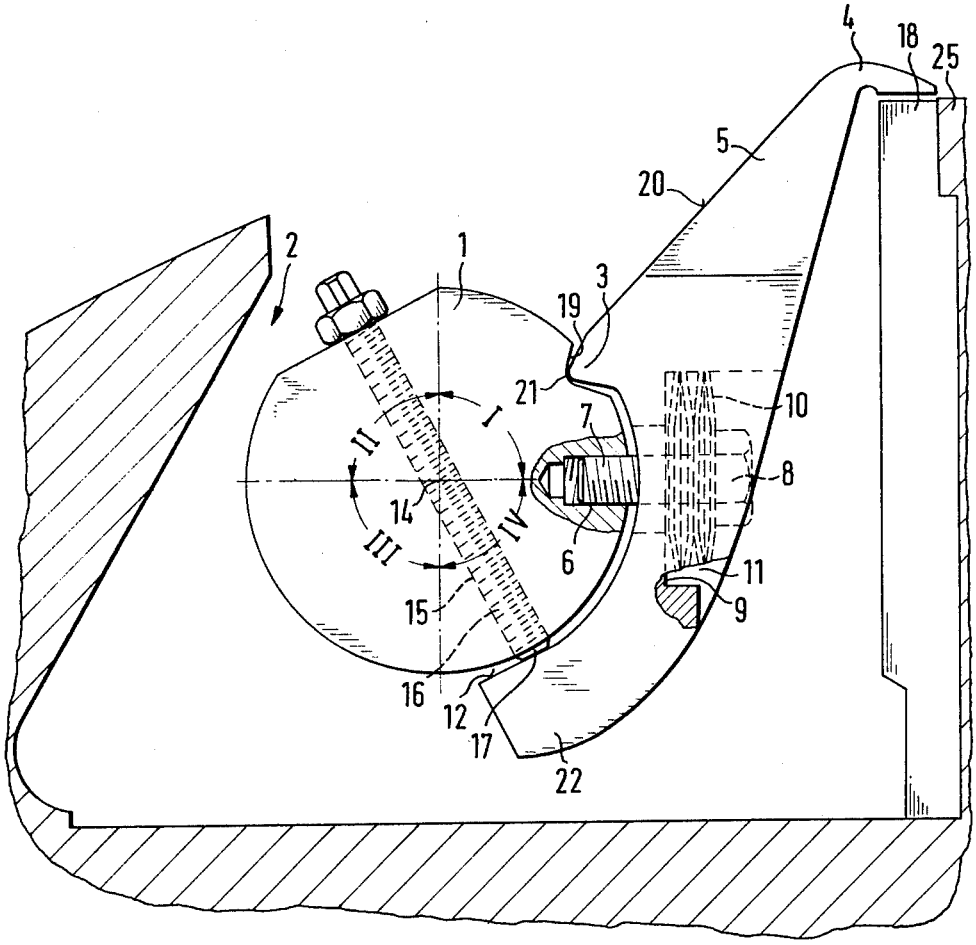
FIG. 1 is a schematic side elevation view, partly in section and with portions removed for clarity of a first preferred embodiments of a sheet gripper in accordance with the present invention.
Figure 2:
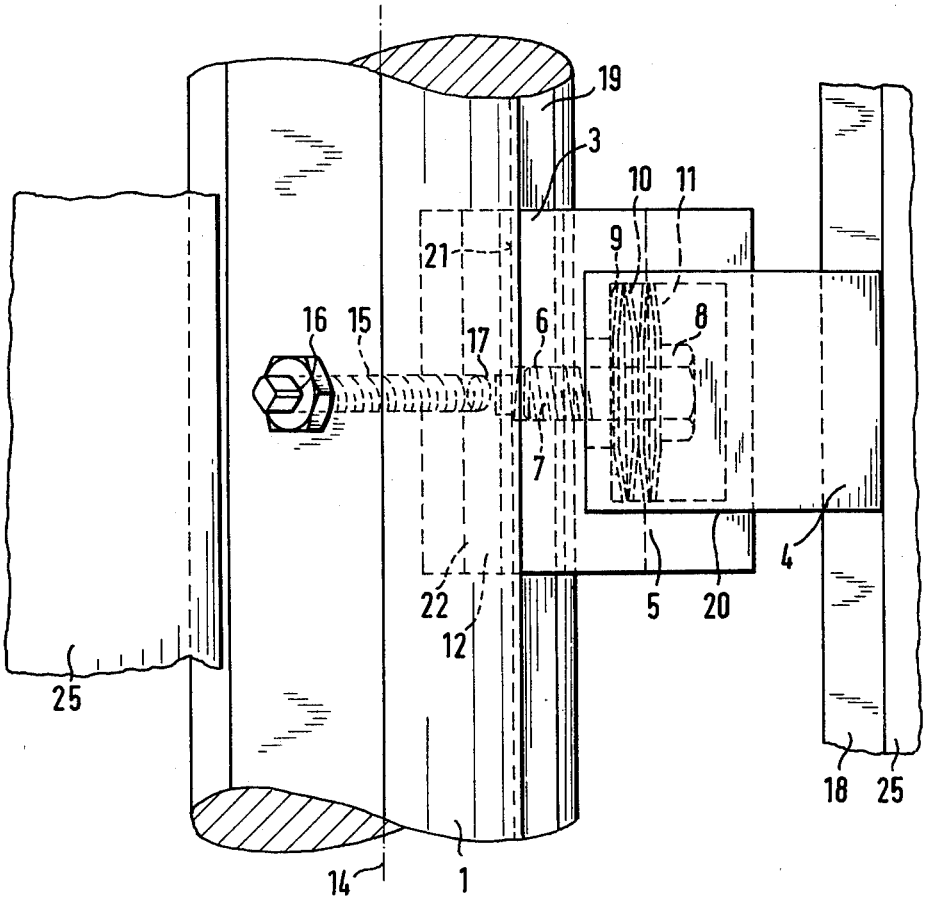
FIG. 2 is a top plan view of the sheet gripper of FIG. 1.

Turning now to FIG. 1, there may be seen a first preferred embodiment of a sheet gripper in accordance with the present invention. While this invention will be discussed for use with a web-fed rotary printing machine, it will be obvious that it could be used with other similar devices. A gripper shaft 1 is located in a gap 2 and journaled in a conventional manner in the side flanges (not shown) of an impression cylinder 25. This gripper shaft 1 is controlled in a conventional manner by a cam and a roller which rotates on the cam with the roller being journaled in a lever arm which is secured to the gripper shaft 1. A notch 19 is milled into the gripper shaft 1, and extends parallel to the longitudinal axis of the gripper shaft 1. The notch of the embodiment shown in FIG. 1 has an approximately wedge-shaped cross section, with the bottom of the notch 19 being directed toward the longitudinal axis 14 of the gripper shaft 1 and being rounded-off. A gripper finger 5 of approximately 15 mm to 30 mm in width has a gripper tip 4 on its upper end and a gripper base 22 on its lower end. Between this gripper tip 4 and this gripper base 22, a side 20 of the gripper finger 5 is directed toward the gripper shaft 1 and has a shoulder 3 which is integrally formed with or secured to the gripper finger 5. Shoulder 3 has a width which is substantially equal to that of the gripper finger and also has a wedge-shaped cross section that is adapted to correspond generally to the cross section of the notch 19 in such a manner that a pivoting movement of the gripper finger on the gripper shaft is possible. The shoulder 3 forms the first part of a hinge assembly and the notch 19 forms the second part of the hinge. A tip portion 21 of the shoulder 3 is rounded off to correspond with the rounded inner surface of the notch 19. Cooperation of shoulder 3 and notch 19 thus form the hinge assembly about which the gripper finger 5 pivots with respect to gripper shaft 1 which oscillates in operation.

Gripper shaft 1 may, for ease of reference, have its cross section divided into four quadrants I, II, III, IV, as seen in FIG. 1, with notch 19 being located approximately in the center of the first quadrant. Between quadrant I and quadrant IV, a plurality of threaded bored holes 6 are provided in the gripper shaft 1 spaced in the direction of its longitudinal axis, and extending inwardly toward the axis of shaft 1. These threaded holes 6 serve to receive hexagon headed screws 7 which are placed in a recess 11 which is milled into the gripper finger 5 under the shoulder 3. Between a base portion 9 of recess 11 and a head portion 8 of the hexagon headed screw 7, a unit for storing mechanic energy, for example, a plurality of compression springs 10, is secured. The compression springs 10 press the shoulder of gripper finger 5 into the notch 19, maintaining contact between shoulder 3 and notch 19 to maintain the hinge free from clearance, even if portions of shoulder 3 have been worn away.

Gripper shaft 1 is provided with a flat surface portion extending in the axial direction of the shaft, with this flat surface being positioned in quadrant II, as may be seen in FIG. 1. This flat surface is placed diametrically opposite the location at which gripper finger base 22 is adjacent shaft 1. A threaded, bored hole 15 passes through the diameter of shaft 1 and extends from the flat surface of shaft 1 in quadrant II to the opposite side of shaft 1 in quadrant IV adjacent gripper base 22. An adjusting screw 16 is screwed into this threaded bored hole 15, and the end of adjusting screw 16 is equipped with a journal 17. Journal 17 seats on a planar surface 12 of the gripper base 22. By means of the adjusting screw 16 it is thus possible to adjust each gripper finger 5 to its corresponding gripper abutment surface 18. Such individual gripper finger adjustment is required for assuring a simultaneous closing and opening of all the gripper fingers 5. The hexagon head screw 7 allows the adjustment of the compression springs 10 and thus of the compression spring force of the gripper finger 5.

Figure 3:
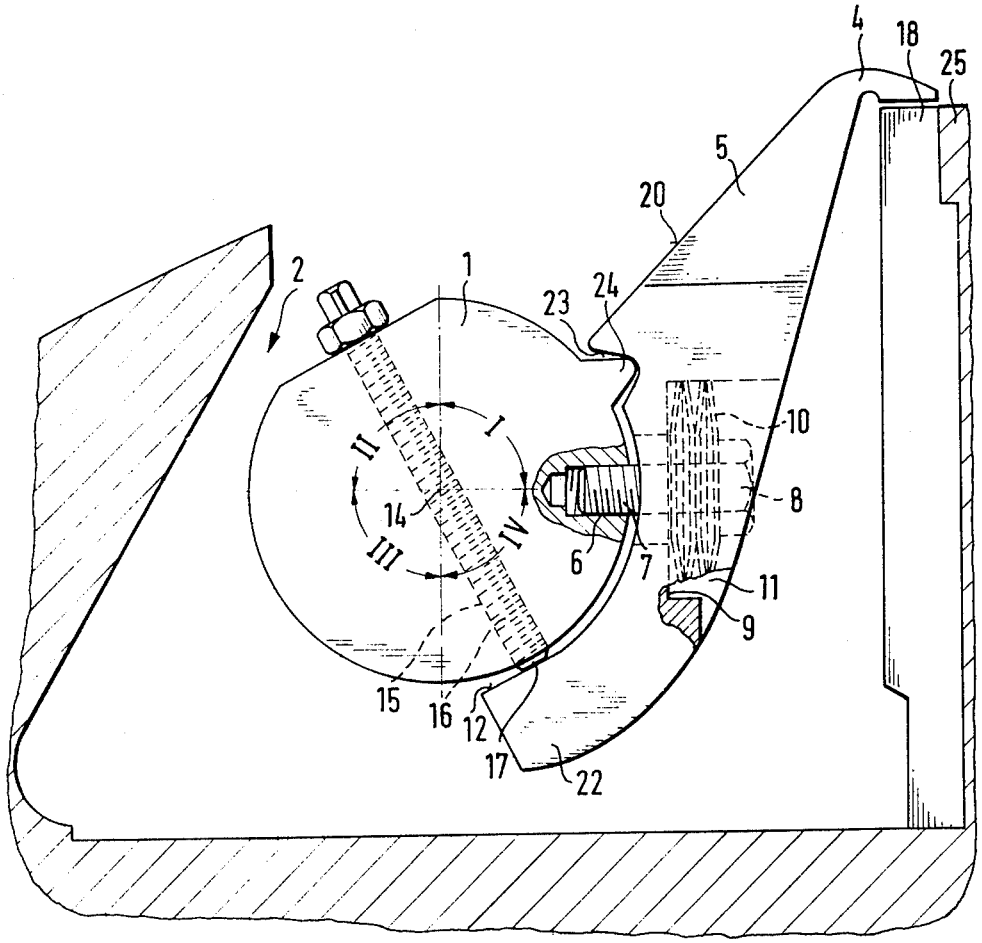
FIG. 3 is a schematic side elevation view, partly in section and with portions removed for clarity of a second preferred embodiment of a sheet gripper in accordance with the present invention.

A second preferred embodiment of a sheet gripper in accordance with the present invention is shown in FIG. 3. In this embodiment, a notch 23 is milled into the gripper finger 5 and forms a first part of a hinge, and a shoulder 24 is formed with or secured to the surface of gripper shaft 1 to form the second part of a hinge. Notch 23 and shoulder 24 have corresponding shapes and cooperate to form the hinge-like joint between the gripper finger 5 and the gripper shaft 1. What was discussed in connection with the first embodiment regarding the shape of shoulder 3 and notch 19, applies also to the shape of shoulder 24 and notch 23. The units of the combinations in the preferred embodiments mentioned above, that is to say notch 19 with shoulder 3, or notch 23 with shoulder 24, may be in line contact or in point contact.

The hinge joint between the shaft 1 and the sheet gripper 5 is, in both embodiments, placed generally midway between the ends of the sheet gripper 5, i.e. generally halfway between gripper tip 4 and gripper base 22. Hence as gripper shaft 1 oscillates to cause gripper tip 4 to move into and out of contact with abutment surface 18 on impression cylinder 25, the gripper 5 can pivot about its hinge joint with shaft 1 to insure that only the desired amount of force is applied to a sheet as it is gripped between the gripper tip 4 and the abutment surface 18. Since the gripper finger 5 is hinged and connected generally at its midpoint, the forces developed due to pivotal motion about the hinge joint are generally equal for the tip end 4 and the base end 22 of the gripper. This equalization of forces reduces wear on the gripper finger 5 and minimizes any tendancy of the finger to rebound after it has been pivoted about the hinge joint. The positioning of the adjusting screw 16 on the shaft 1 also reduces the weight of the gripper finger 5 and reduces the impact of the gripper base 22 against the journal 17 if the gripper finger springs back into place after having its tip 4 contact abutment surface 18.

While preferred embodiments of a sheet gripper in accordance with the present invention have hereinabove been fully and completely disclosed, it will be obvious to one of ordinary skill in the art that a number of changes in for example, the type of springs used, the shape of the gripper tip, the shape of the gripper base and the like could be made without departing from the true spirit and scope of the invention and that the invention is to be limited only by the following claims.

I claim:

1. A sheet gripper for the impression cylinder of a web-fed rotary printing machine, the impression cylinder carrying an oscillating gripper shaft and an abutment surface at a peripheral portion of the cylinder, said sheet gripper comprising:

a gripper finger having a gripper tip at a first end and a gripper base at a second end of said gripper finger;

means for directly securing said gripper finger to the oscillating gripper shaft, said securing means including a securing screw passing through said gripper finger between said gripper base and said gripper tip and adapted to be directly received in a threaded hole in the gripper shaft, and a spring means retained between a head portion of said securing screw and said gripper finger to spring bias said gripper finger toward the gripper shaft;

a hinge joint between said gripper finger and the gripper shaft for allowing relative pivotal movement between said gripper finger and the gripper shaft during operation of the printing machine, said hinge joint being formed by a portion of said gripper finger having a first shape and a corresponding portion of the gripper shaft having a corresponding second shape, said shaped portion of the gripper shaft extending along the length of the gripper shaft and parallel to the axis of the gripper shaft;

an adjusting screw for adjusting the spacing between said gripper tip and the abutment surface, said adjusting screw passing through the gripper shaft and contacting said gripper base whereby oscillation of the gripper shaft causes said gripper tip to contact the abutment surface and to pivot about said hinge joint upon contact between said tip and abutment surface; and said gripper finger extending around only a portion of the periphery of the gripper shaft so that said gripper finger is removable from the gripper shaft by unsecuring said securing screw from the gripper shaft, said gripper finger being removable while leaving the gripper shaft in the printing machine.

2. The sheet gripper of claim 1 wherein said hinge joint is a shoulder on said gripper finger and a cooperating notch on the gripper shaft.

3. The sheet gripper of claim 1 wherein said hinge joint is a notch on said gripper finger and a cooperating shoulder on the gripper shaft.

4. The sheet gripper of claim 2 wherein said notch and shoulder having wedge-shaped cross sections.

5. The sheet gripper of claim 3 wherein said notch and shoulder have wedge-shaped cross sections.

* * * * *